United States Patent [19]

Yuchi

[11] Patent Number: 5,017,905

[45] Date of Patent: May 21, 1991

[54] FIRE ALARM SYSTEM

[75] Inventor: Sadataka Yuchi, Kanagawa, Japan

[73] Assignee: Hochiki Corporation, Tokyo, Japan

[21] Appl. No.: 593,471

[22] Filed: Oct. 2, 1990

Related U.S. Application Data

[63] Continuation of Ser. No. 277,236, Nov. 29, 1988, abandoned.

[30] Foreign Application Priority Data

Nov. 30, 1987 [JP] Japan ..... 62-302834
Dec. 26, 1987 [JP] Japan ..... 62-330544

[51] Int. Cl.[5] ..... G08B 29/00

[52] U.S. Cl. ..... 340/506; 340/505; 340/510; 340/511; 340/514

[58] Field of Search ..... 340/505, 506, 514, 510, 340/508, 511, 825.06

[56] References Cited

U.S. PATENT DOCUMENTS 4,162,488 7/1979 Silverman et al. ..... 340/505
4,228,424 10/1980 LeNay et al. ..... 340/506
4,249,166 2/1981 Schultz ..... 340/505
4,622,538 11/1986 Whynacht et al. ..... 340/506
4,668,939 5/1987 Kimura et al. ..... 340/505
4,740,787 4/1988 Kimura ..... 340/825.08

*Primary Examiner*—Donnie L. Crosland
*Attorney, Agent, or Firm*—Michael N. Meller

[57] ABSTRACT

In a fire alarm system including a plurality of addressable detectors connected to a main circuit extended from a central receiving unit, any alarming detector is discriminated and indicated in accordance with its address on the receiving unit side. In this system, one of the addressable detectors is assigned as a group master detector to each of areas under surveillance and the other detectors within the same area under surveillance have no addressing function. The unaddressable detectors are dependently connected to the group addressable detector within the same area under surveillance. Each of the addressable detectors includes a current limiting circuit which upon alarming limits the amount of current supplied to the main circuit to which the addressable detector is connected, and a changeover circuit for changing over the limited current value by the current limiting circuit to a lower value in response to an address-designated control signal supplied from the receiving unit when the number of alarming detectors exceeds a predetermined number.

6 Claims, 5 Drawing Sheets

CENTRAL RECEIVING UNIT
(RECEIVER)
101
−
+
102a
102b
103
113b
130a
113a
114a
119a
130b
FIRE DETECTING MEANS
120
114b
115a
115b
104
119b
116a
SLAVE DETECTOR
CURRENT DETECTING CIRCUIT
105
116b
SLAVE DETECTOR
123
DISCONNECTION DETECTING CIRCUIT
116n
SLAVE DETECTOR
TRANSMISSION CIRCUIT
106
107
ADDRESS SETTING CIRCUIT
117

FIRE ALARM SYSTEM

This application is a continuation, of application Ser. No. 277,236, filed Nov. 29, 1988 now abandoned.

BACKGROUND OF THE INVENTION

The present invention relates to a fire alarm system including a plurality of fire detectors connected to power supply and signal lines connected to a central receiving unit (reciever) whereby when a fire breaks out, the location of the fire is discriminated by the receiver in accordance with the specified address of any detector that has given an alarm.

In the case of a large-scale fire detecting system covering a wide area under surveillance, its equipment construction is such that a plurality of repeaters are connected to a main circuit extended from a receiver and a plurality of fire detectors are connected to a branch circuit extended from each of the repeaters.

On the other hand, in the case of a fire alarm system of a medium scale or less covering an area under surveillance which is not so wide, its equipment construction is such that the previously mentioned repeaters are not provided and a plurality of detectors are connected to each of a plurality of circuits extended from a receiver.

Then, recently a system has been developed in which in order to discriminate and indicate an area on fire by a receiver, a specified address signal is assigned to each of a plurality of addressable detectors such that such specified address is sent, along with a fire detection signal, to the receiver from any alarming detector.

However, with the fire alarm system in which all of the detectors are each assigned with its own specified address signal, it is necessary that the plurality of detectors installed within the same area under surveillance such as the same floor of a building must respectively be assigned with different address signals and that for the system on the whole every one of the detectors must be provided with a circuit function to send its own address signal to the receiver upon detection of a fire, thus increasing the equipment cost of the fire alarm system and thereby greatly preventing the practical use of a function of discriminating the indicating areas on fire by the receiver.

Also, where a specified address signal is assigned to every one of the detectors, there is the disadvantage that the area under surveillance will be limited excessively if there is a limitation to the number of addresses, whereas the burden on the signal discriminating capacity of the receiver will be increased if the number of addresses is excessively large.

Moreover, when the number of the alarming detectors is increased by the spreading of the fire after its outbreak, as the number of the alarming detectors connected to the same circuit is increased, the current flowing in the circuit is increased and the supply voltage to the detectors is decreased due to the effect of the voltage drop caused by the line resistance. As a result, the clock pulse voltage for sending the fire detection information and the specified address information from each alarming detector to the receiver becomes in insufficient and eventually a point is reached where there is the danger of the transmission of information being disabled. This deteriorates the advantage of the fire alarm system employing the addressable detectors that the progress of the spread of the fire can also be grasped moment by moment on the receiver side.

SUMMARY OF THE INVENTION

It is the primary object of the present invention to provide a fire alarm system capable of covering wide areas under surveillance with a relatively small number of addressable detectors.

It is another object of the invention to provide such fire alarm system which, in addition to the above-mentioned main object, is capable of ensuring that even if the number of alarming detectors within the same circuit is increased, the transmission of the necessary information to a central receiving unit from the alarming detectors is maintained unless the circuit is disconnected.

In accordance with the invention, there is thus provided a fire alarm system including a central receiving unit, power supply and signal main lines connected to the central receiving unit, and a plurality of fire detectors formed into one or more groups each corresponding to an area under surveillance and connected to the power supply and signal main lines, wherein the fire detectors include a plurality of master detectors (addressable detectors) each assigned to one of the groups as a group master detector and a plurality of slave detectors (unaddressable detectors) one or more of which are assigned to each of the groups, the one or more slave detectors being connected to the group master detector in each of the groups, and wherein each group master detector includes transmission means responsive to the detection of a fire by the group master detector itself or the detection of a fire by the one or more detectors connected to the former to send a fire detection signal and an address signal peculiar to the group to the central receiving unit.

In accordance with one preferred aspect of the invention, each of the group master detectors includes a mounting base and fire detecting means detachably mounted on the base, and the transmitting means is disposed on the mounting base.

In accordance with another preferred aspect of the invention, a terminal circuit element is connected to the group master detector of each group to supply a small steady-state monitor current to a power supply and signal local lines connecting the group master detector and the slave detector or detectors, and also the group master detector includes disconnection detecting means for generating a disconncection signal when the steady-state monitor current becomes smaller than given value.

In accordance with still another preferred aspect of the invention, each of the fire detectors includes switching means adapted to be turned on upon the detection of a fire to supply an alarm current, and each of the master detectors includes current limiting means for limiting the alarm current to a constant current value of a magnitude sufficient to maintain the ON state of the switching means. In this case, each of the fire detectors should preferably be of the type including pulse driving means for periodically turning on the switching means upon the detection of a fire, and it should more preferably be designed such that the central receiving unit includes control means for determining the number of the master detectors which have given the alarm so as to deliver a control signal or signals designating the specified addresses of the unalarming master detectors to the power supply and signal main lines when the number of the alarming master detectors exceeds a predetermined number and that each of the master detectors includes current limit changeover means for changing over the limited current value of its own current limiting means to a lower value than the constant current value when the control signal from the central receiving unit is discriminated according to its specified address by the transmission means.

Further, both the master detector and the slave detector are provided respectively with an alarm indicating light-emitting diode which can be turned on by its own alarm current, whereby emitting at a scene may be observed visually.

In accordance with another form of the invention, there is provided a fire alarm system so designed that plurality addressable detectors each having a specified address are connected to power supply and signal main lines connected to a central receiving unit, that each of the addressable detectors includes fire detecting means having switching means responsive to the detection of a fire so as to be turned on and maintained so to supply an alarm current, current detecting means for detecting the alarm current and transmission means responsive to the detection of the alarm signal by the current detecting means to send a specified address signal to the power supply and signal main lines and to selectively take in the control signals delivered to the power supply and signal main lines from the central receiving unit in accordance with their address information, and that the central receiving unit includes indicating means for receiving the transmitted specified address signals through the power supply and signal main lines to discriminate and indicate the alarming detectors. In this case, the central receiving unit includes control means responsive to the received specified address signals to deliver to the power supply and signal main lines control signals designating the specified addresses of the unalarming detectors when the number of the alarming addressable detectors exceeds a predetermined number, and each of the addressable detectors includes current limiting means for limiting the alarm current generated upon the detection of a fire to a constant current value sufficient to maintain the ON state of the switching means and current limit changeover means for changing over the limited current value of its own current limiting means to a value smaller than the constant current value when the transmission means receives the control signal of the address corresponding to itself from the power supply and signal main lines.

Each of these addressable detectors is a group master detector and one or a plurality of slave detectors, i.e., unaddressable detectors each thereof having no specified address signal of its own and serving only the function of transmitting a fire detection signal to the master detector are made dependent on the master detector.

In accordance with the fire alarm system of this invention, the plurality of fire detectors installed within the same area under surveillance comprise a single addressable master detector (group master detector) and one or more dependent unaddressable slave detectors which are formed into a group. Thus, since it is necessary to provide only the group master detector with the required address signal transmitting function and since the ordinary fire detector having no specified address can be used as such for each slave detector, the fire stricken area discriminating and indicating function of the central receiving unit can be simplified with the resulting reduction in the equipment cost and the wide use of systems having the function of discriminating and indicating the location of a fire can be made more realistic even in the case of equipment which are middle and small in scale. Also, it is possible to realize a fire alarm system with a burning area discriminating and indicating function which is capable of effectively utilizing the limited number of addresses to cover wide areas under surveillance with a reduced number of addressable detectors.

Each of the addressable detectors (master detectors) transmits its own detection of a fire and the detection of a fire by each of one or more unaddressable detectors (slave detectors) dependent on itself, along with its specified address signal, to the central receiving unit. Where the plurality of master detectors connected to the same circuit send their fire detection signals to the central receiving unit, the central receiving unit monitors the number of the alarming detectors within the same circuit so that when it exceeds a predetermined number, the central receiving unit sends to the circuit control signals each designating the address of one of the unalarming master detectors on the circuit. Each of the unalarming master detectors takes in the control signal having the address corresponding to the address of its own so that the limited current value by the current limiting means of its own is changed over for example to a current value lower than the steady-state monitor current value. When this occurs, even if the fire is detected by the master detectors having their limited current values changed over to the lower current value and their dependent slave detectors, the line currents between them and the central receiving unit are practically increased no longer and the net line current corresponding to the number of the previous alarming master detectors is maintained. As a result, the voltage drop due to the line resistance of the power supply and signal main lines between the central receiving unit and the master detectors is increased no longer and the reduction in the supply voltage to the detectors is suppressed, thereby ensuring the transmission of information between the central receiving unit and the master detectors.

It is to be noted that when the detection of the fire is made by any master detector having the limited current value changed over to the lower current value and its dependent slave detectors, while in the fire detecting means of the master detector the switching element such as a thyristor is no longer held in the ON state by the self-holding, the thyristor is turned on so long as the fire detection output is generated so that this conduction is detected by current detection in the master detector and an alarm signal and its own address signal are sent to the central receiving unit through the transmission means.

The above and other objects and advantages of the invention will become more apparent from the following detailed description of its preferred embodiments taken in conjunction with the accompanying drawings.

DESCRIPTION OF THE PREFERRED EMBODIMENTS

Figure 1:
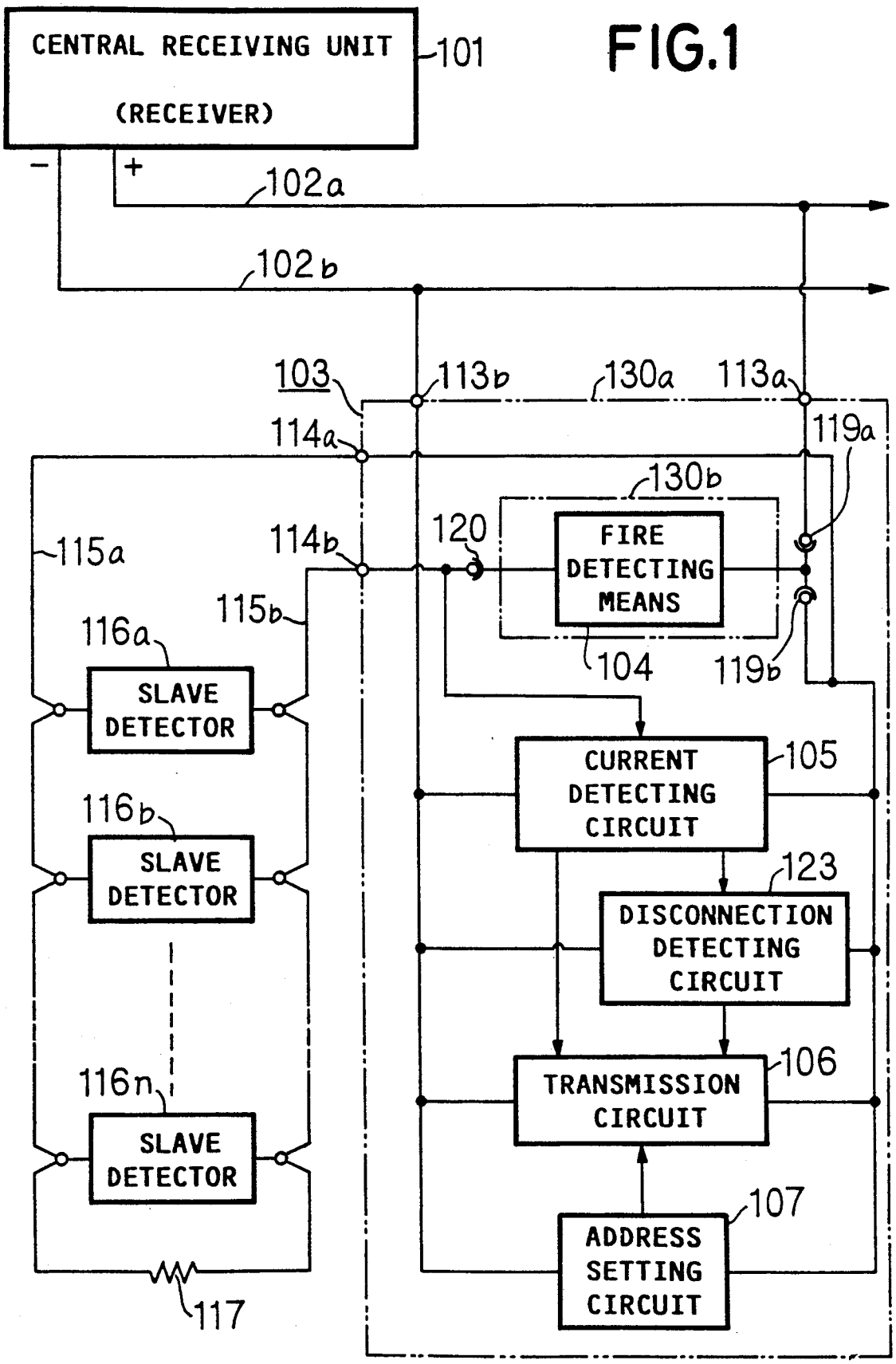
FIG. 1 is block diagram showing first embodiment of the present invention.

Referring to FIG. 1, a receiver 101 forms a central receiving unit having a functin so that when the fire detection signal from a detector installed in an area under surveillance is received, the address signal sent simultaneously from the detector is received and decoded to give a fire alarm and also to discriminate and indicate the fire stricken area. Connected to the receiver 101 are power supply and signal main lines 102*a* and 102*b* forming a main circuit extended to areas under surveillance, and connected in parallel with the main circuit 102*a*, 102*b* are a plurality of master detectors (addressable detectors) 103 which are arranged one for each area under surveillance. Note that while only the single master detector 103 arranged as a group master detector in the particular area under surveillance is shown, it is needless to say that the similar master detectors serving the other areas under surveillance are connected in parallel with the main circuit 102*a*, 102*b*, one for every area under surveillance.

The master detector 103 includes a mounting base 130*a* for attachment to a ceiling or the like and a detector proper 130*b* adapted to be detachably mounted on the base 130*a*, and power supply and signal local lines 115*a* and 115*b* forming a local circuit extended to the same area under surveillance are respectively connected to local connection terminals 114*a* and 114*a* provided on the base 130*a*. A plurality of slave detectors 116*a*, 116*b*, . . . 116*n* are connected in parallel with the local circuit 115*a*, 115*b* and a terminal resistor 117 for disconnection detecting purposes is connected to the terminal end of the local circuit. As is well known in the art, the detector proper 130*b* includes suitable fire detecting means 104 such as a photoelectric smoke detecting mechanism or ionization smoke detecting mechanism and the mounting base 130*a* includes fit terminals 119*a*, 119*b* and 120 for removably attaching and electrically connecting the fire detecting means 104, a current detecting circuit 105, a disconnection detecting circuit 123, a transmission circuit 106 and an address setting circuit 107.

The current detecting circuit 105 receives not only the detection output (current output) of its own fire detecting means 104 mounted on the detector proper 130*b* but also the detection outputs (current outputs) of the plurality of slave detectors 116*a*, 116*b*, . . . 116*n* from the local circuit 115*a*, 115*b* through the local connection terminals 114*a* and 114*b*, so that the alarm current caused by the detection of a fire by its own fire detecting means 104 or the detection of a fire by any of the slave detectors 116*a*, 116*b*, . . . 116*n* is detected by the current detecting circuit 105 whose current detection output (fire detection output) is in turn applied to the transmission circuit 106.

The mounting base 130*a* is also provided with connecting terminals 113*a* and 113*b* for connection with the main circuit (102*a*, 102*b*). One of the terminals of the detector proper 130*b* including the fire detecting means 104 is mechanically fitted so as to provide an electric connection between the fit terminals 119*a* and 119*b* which are separately disposed on the power supply line on the positive side (the main circuit 102*a* side) of the mounting base 130*a* and the other terminal of the detector proper 130*b* is electrically and mechanically connected to the connection terminal 120 which is also provided on the mounting base 130*a*. Also, the local connection terminal 114*a* to which the plurality of slave detectors 116*a*, 116*b*, . . . 116*n* are connected is connected to the power supply line on the fit terminal 119*a* side and the other local connection terminal 114*b* is connected, along with the connection terminal 120, to the input of the current detecting circuit 105. The reason for electrically separating the fit terminals 119*a* and 119*b* of the mounting base 130*a* as mentioned previously is to simultaneously interrupt both the power supply to the current detecting circuit 105 and following circuit portions and the power supply to the slave detectors 116*a*, 116*b*, . . . 116*n* when the detector proper 130*b* is removed from the mounting base 130*a*. In this way, the present embodiment is constructed such that the slave detectors 116*a*, 116*b*, . . . 116*n* are in dependent relation with the master detector 103 to allow the slave detectors 116*a*, 116*b*, . . . 116*n* to become effective only when the master detector 103 is functioning properly.

In such a condition as the power supply is interrupted, it becomes impossible for the master detector 103 to response to the polling from the receiver 101. Taking advantage of this condition, it becomes also possible to detect the disconnected detector at the receiver side.

The disconnection detecting circuit 123 receives a small disconnection monitor current flowing through the terminal resistor 117 in the local circuit 115*a*, 115*b* to which the slave detectors 116*a*, 116*b*, . . . 116*n* are connected and thus a disconnection detection output is applied to the transmission circuit 106 when the disconnection monitor current is interrupted.

A specified address signal is established for the transmission circuit 106 by the address setting circuit 107 so that when a current detection output or fire detection output is received from the current detection circuit 105, an alarm signal including the fire detection information and the address information is transmitted to the receiver 101, whereas when a disconnection detection output is received from the disconnection detecting circuit 123, an output signal including the disconnection detection information and the address information is transmitted to the receiver 101 in response to the call by means of the polling function of the receiver 101. The frame structure of the transmission signal sent to the receiver 101 from the transmission circuit 106 includes a start flag, address information, fire information bit, disconnection information bit and end flag. Of course, the frame structure is not limited to this structure and any suitable frame structure may be employed provided that it includes fire detection information and address information when a fire is detected and it includes address information and disconnection detection information when a disconnection is detected.

The operation of this embodiment is as follows.

To begin with, the master detector 103 and the slave detectors 116*a*, 116*b*, . . . 116*n* are installed in the same area under surveillance so that when a fire breaks out in this area thus causing for example the fire detecting means 104 in the detector proper 130*b* of the master detector 103 to detect the fire, the fire detecting means 104 comes into operation and an alarm current flows to the current detecting circuit 105 provided on the mounting base 130*b*, thus causing the current detecting circuit 105 to apply a current detection output or fire detection output to the transmission circuit 106. The transmission circuit 106 transmits the fire detection information as well as the address information set by the address setting circuit 107 in a signal form of a given data frame structure to the receiver 101 through the main circuit 102*a*, 102*b* in response to the polling from the receiver 101 so that upon receiving the signal from the master detector 103, the receiver 101 discriminates the installation area of the alarming master detector in accordance with the address information in the signal to indicate the fire stricken area.

On the other hand, if any of the slave detectors 116*a*, 116*b*, . . . 116*n*, e.g., the slave detector 116*a* detects the fire, an alarm current is supplied through the circuit 115*a*, 115*b* to the current detecting circuit 105 disposed on the mounting base 130*a* of the master detector 103 so that a detection output is applied from the current detecting circuit 105 to the transmission circuit 106 which in turn transmits data of the given data frame structure including the address information and fire detection information to the receiver 101. Thus, in the like manner as in the case of the fire detection by the master detector 103, the receiver 101 decodes the address information to discriminate and indicate the fire stricken area.

Thus, it is only necessary that of the plurality of detectors installed in the same area under surveillance, only the single master detector 103 is provided with a function of transmitting its address signal to the receiver 101 and the ordinary detectors having no address transmitting function can be used as such for the plurality of slave detectors 116*a*, 116*b*, . . . 116*n* which are dependently connected to the master detector 103. As a result, although the fire alarm system is one having the fire stricken area discriminating and indicating function, it ensures the use of a considerably reduced number of addressable detectors having an address transmission function and this greatly simplifies the equipment construction.

Figure 2:
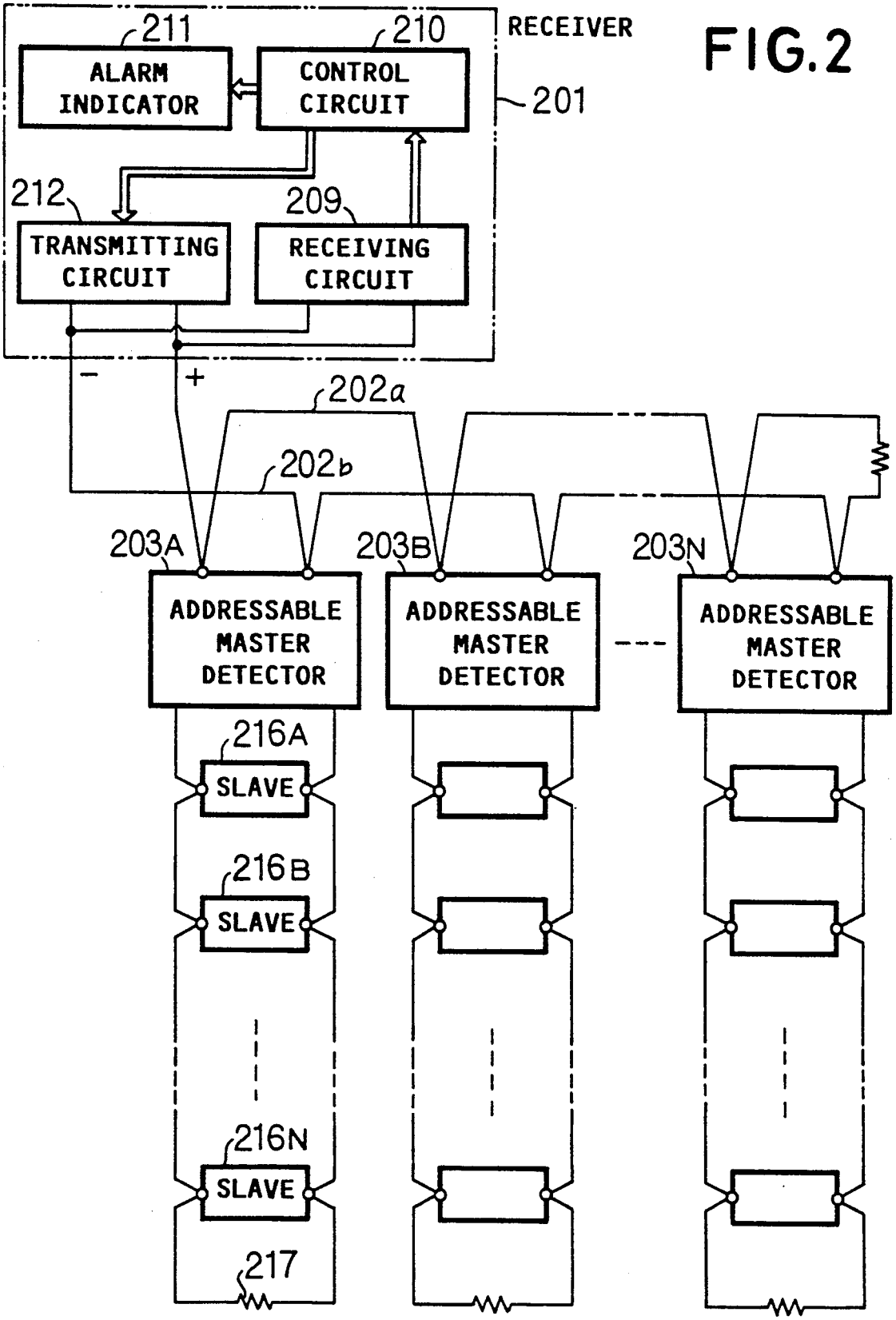
FIG. 2 is a block diagram showing a second embodiment of the invention.

Referring now to FIG. 2, there is illustrated a second embodiment of the invention which is so designed that with a plurality of master detectors connected to the same main circuit, when the number of the alarming detectors exceeds a certain upper limit, an address-designated control signal is transmitted from the receiver side to limit the current flowing in the fire detecting means of each of the master detectors which have generated no alarm as yet.

In FIG. 2, numeral 201 designates a receiver forming a central receiving unit and a plurality of addressable master detectors 203A, 203B, . . . 203N respectively corresponding to the respective areas under suveillance are connected to power supply and signal main lines 202*a* and 202*b* forming a main circuit connected to the receiver 201. Also, a plurality of unaddressable slave detectors 216A, 216B . . . 216N are connected to each of the addressable detectors.

The receiver 201 includes a receiving circuit 209 and a transmitting circuit 212 which are connected to the main circuit 202*a*, 202*b*, a control circuit 210 and an alarm indicator 211, so that the transmission signal including fire information and address information and transmitted in response to the detection of a fire by any of the addressable detectors 203A, 203B, . . . 203N is received and decoded by the receiving circuit 209 and a reception output is applied to the control circuit 210. The control circuit 210 decodes the fire detection information and the address information to cause the alarm indicator 211 to generate a fire alarm, indicate the fire alarm and indicate the fire stricken area in accordance with the address information.

The control circuit 210 determines that the number of the alarming master detectors has reached a predetermined upper limit number so that the transmitting circuit 212 transmits to the main lines 202*a*, 202*b* an address-designated current limiting control signal for each of the unalarming master detectors connected to the main circuit. This current limiting control signal transmitting function of the control circuit 210 is such that when the alarms from a total of the two addressable detectors, for examples, are detected as the result of the information sent from a certain main circuit, current limiting control signals designating the specified addresses of all the other unalarming master detectors connected to the same main circuit are sent to the main circuit.

Figure 3:
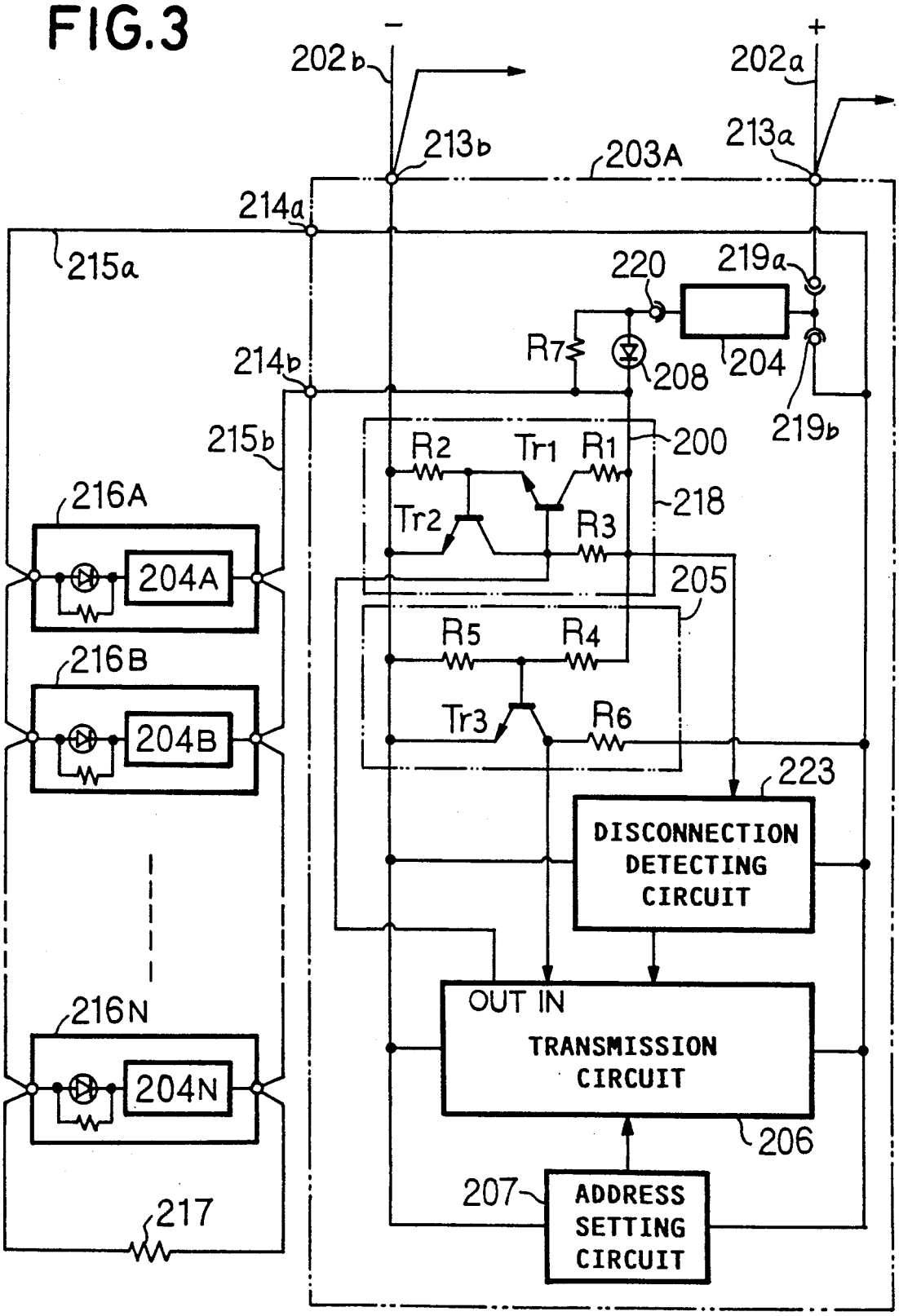
FIG. 3 is a circuit diagram showing an example of one of the master detectors in the second embodiment and its attendant circuits construction.

FIG. 3 shows in partial block diagram form the circuit construction of the addressable detector 203A which is one of those shown in FIG. 2. As shown in the Figure, the single master detector and the plurality of slave detectors are installed in the same area under surveillance to form a group and the address signal of the master detector represents the group.

In FIG. 3, the main circuit 202*a*, 202*b* from the receiver 201 are respectively connected to connection terminals 213*a* and 213*b* of the addressable master detector 203A, and the plurality slave detectors 216A to 216N comprising the ordinary detectors having no specified address signals are connected in parallel with a local circuit formed by power supply and signal local lines 215*a* and 215*b* separately extended from local connection terminals 214*a* and 214*b* of the master detector 203A. A disconnection detecting terminal resistor 217 is connected to the terminal end of the local circuit 215*a*, 215*b*.

Figure 4:
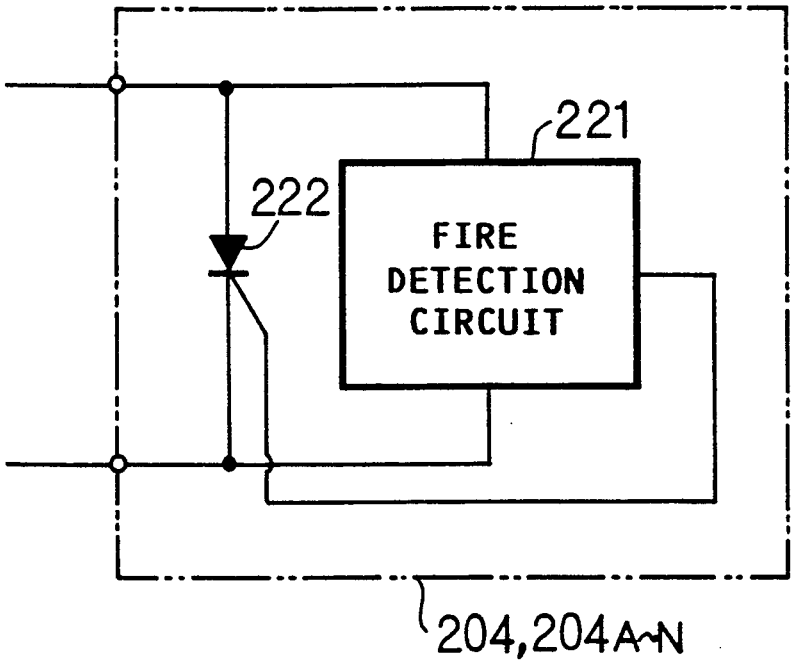
FIG. 4 is circuit diagram showing an example of the construction of the fire detecting means in the circuitry of FIG. 3.

Fire detecting means 204 and 204A to 204N are respectively detachably incorporated in the master detector 203A and the unaddressable slave detectors 216A to 216N, and each of the fire detecting means comprises for example a combination of a fire detection circuit 221 utilizing a photoelectric-type or ionization-type smoke detecting mechanism and a thyristor 222 serving as a switching element as shown in FIG. 4. For example, taking the case of utilizing the photoelectric smoke detecting mechanism, the fire detection circuit 221 is constructed so that intermittent light pulses are repeatedly applied within the detection chamber of its fire detecting mechanism and the scattered light due to the smoke entering the chamber is detected by a photosensitive element to produce a fire detection output for turning on the thyristor 222 when the photosensitive output attains a given level. In other words, the fire detection circuit 221 is constructed so as to generate a fire detection output intermittently upon the detection of a fire. The fire detection output is applied to the gate electrode of the thyristor 222 so that the thyristor 222 is triggered into a conduction state by the output of the fire detection circuit 221 to supply an alarm current to the local circuit 215*a*, 215*b*. In this case, when the thyristor 222 is turned on and held in this state by itself, the alarm current flows continuously, whereas when no self-holding is provided, the alarm current flows intermittently in response to the pulses.

The addressable master detector 203A includes a current detecting circuit 205 for detecting the alarm current caused by the detection of a fire by the fire detection circuit 204, a disconnection detecting circuit 223 for applying a disconnection detection output to a transmission circuit 206 upon the interruption of a weak monitor current flowing to the local circuit 215*a*, 215*b* through the terminal resistor 217, the transmission circuit 206 whereby fire detection information is transmitted, along with the specified address signal set by an address setting circuit 207, to the receiver 201 when the current detecting circuit 205 generates a detection output and disconnection detection information and the specified address signal are transmitted to the receiver 201 when the disconnection detecting circuit 223 generates a detection output, and a current limiting circuit 218 inserted between the fire detecting means 204 and the current detecting circuit 205. It is to be noted that in the case of the Figure, connected between the fire detecting means 204 and current limiting circuit 218 is an alarm indicating light-emitting diode 208 which is turned on by the alarm current and also connected in parallel with the light-emitting diode 208 is a resistor $R_7$ for preventing the light-emitting diode 208 from being turned on during the steady-state monitoring in the non-firing condition and protecting it. Also, the similar alarm indicating circuit is provided for each of the slave detectors 216A to 216N.

The current limiting circuit 218 has a current regulating function whereby the alarm current generated upon the detection of a fire is limited to a constant current value of the order which is sufficient for the thyristor 222 in the fire detecting means 204 (or any of 204A to 204N) of the alarming detector to self-hold it in the conductive state and also sufficient for turning on the light-emitting diode 208 for indicating the alarm of the alarming detector, e.g., 6mA.

In this case, the alarm indicating light-emitting diode 208, the current limiting circuit 218, the current detecting circuit 205, the disconnection detecting circuit 223, the transmission circuit 206 and the address setting circuit 207 of the master detector 203A are incorporated in the mounting base for mounting the master detector on a ceiling or the like and the fire detecting means 204 is disposed on the detector proper which is detachably mounted on the mounting base. In other words, in FIG. 3 the fire detecting means 204 disposed on the detector proper is detachably connected to positive-side separated fit terminals 219*a* and 219*b* and a negative-side fit terminal 220 which are disposed on the mounting base. Thus, when the detector proper including the fire detecting means 204 is removed from the mounting base, the connection between the fit terminals 219*a* and 219*b* is opened and the power supply to the respective circuits incorporated in the mounting base is interrupted.

On the other hand, the local circuit 215*a*, 215*b* to which the plurality of slave detectors are connected are respectively connected to the local connection terminals 214*a* and 214*b* which are disposed on the mounting base of the master detector 203A. Of these connection terminals, the connection terminal 214*a* is connected to the positive-side power line on the fit terminals 219*b* side and the other connection terminal 214*b* is connected between the alarm indicating light-emitting diode 208 and the current limiting circuit 218. As a result, not only the fire detecting means 204 of the master detector 203 but also the fire detecting means of the slave detectors 216A to 216N are connected in parallel with the current limiting circuit 218 of the master detector 203A so that the previously mentioned current limitation by the current limiting circuit 218 is performed when any of these detectors is brought into operation upon the detection of a fire thereby supplying an alarm current.

The current limiting circuit 218 disposed in the master detector 203A forms a current regulating circuit with transistors $T_{r1}$ and $T_{r2}$ and resistors $R_1$, $R_2$ and $R_3$. With the current limiting circuit 218, in the steady-state monitoring condition the transistor $T_{r1}$ is turned on and the transistor $T_{r2}$ is turned off so that a steady-state monitor current of about 0.7mA, for example, is supplied through the transistor $T_{r1}$. On the other hand, when a fire is detected so that the fire detecting means 204 of the master detector 203A or any of the fire detecting means 204A to 204N of the slave detectors comes into operation to supply an alarm current, the collector current of the transistor $T_{r1}$ is controlled by the transistor $T_{r2}$ to establish a current regulating operating condition. At this time, the limited current value I flowing through the transistor $T_{r1}$ is given as follows, if $r_2$ represents the resistance value of the resistor $R_2$ and $V_{BE}$ represents the base-emitter voltage of the transistor $T_{r1}$ $$I = V_{BE}/r_2$$

In this embodiment, the current detecting circuit 205 arranged to follow the current limiting circuit 218 is composed of a voltage comparator including a transistor $T_{r3}$ and resistors $R_4$ and $R_5$ so that a voltage input corresponding to the value of the previously mentioned limited current flowing in the current limiting circuit 218 is divided by the resistors $R_4$ and $R_5$ and applied to the base electrode of the transistor $T_{r3}$.

In the steady-state monitoring condition, the impedance of the fire detecting means 204 (or 204A to 204N) is large enough as compared with that of the current limiting circuit 218 so that the value of the limited current flowing in the current limiting circuit 218 is reduced for example to 0.7mA and thus the base input voltage of the transistor $T_{r3}$ is correspondingly reduced and the transistor $T_{r3}$ is turned off. When the impedance of the fire detecting means 204 (or 204A to 204N) is made small enough as compared with that of the current limiting circuit 218 upon the detection of fire, the current limiting circuit 218 comes into the current regulating operation and the alarm current flowing through the transistor $T_{r1}$ is limited to a constant value, e.g., 6mA. When this flow condition of the constant current value is attained, the base input voltage of the transistor $T_{r3}$ is increased as compared with that in the previous steady-state monitoring condition and thus the transistor $T_{r3}$ is turned on.

The collector output of the transistor $T_{r3}$ of the current detecting circuit 205 is applied to the input terminal IN of the transmission circuit 206. In the steady-state monitoring condition where the transistor $T_{r3}$ is turned off, the input terminal IN is set to an H level through the resistor $R_6$ and the input terminal IN is pulled down to an L level in response to the turning on of the transistor $T_{r3}$ upon the detection of a fire. When the input terminal IN is pulled down to the L level, the transmission circuit 206 sends the fire detection information as well as the specified address information set by the address setting circuit 207 toward the receiver 201.

In addition, the transmission circuit 206 receives the current limiting control signal supplied from the receiver 201 shown in FIG. 2 so that when the designated address of the received control signal coincides with its own specified address, a control output for limited current value changeover purposes is generated and its output terminal OUT is set to the L level. The output terminal OUT of the transmission circuit 206 is connected to the collector electrode of the transistor $T_{r2}$ included in the current limiting circuit 218.

Since the output terminal OUT of the transmission circuit 206 is in the high impedance condition of the H level in the steady-state monitoring condition, the current limiting circuit 218 performs the previously mentioned current limiting operation without any difficulty. On the other hand, when the transmission circuit 206 receives from the receiver 201 a control signal whose address content designates itself, the transmission circuit 206 sets its output terminal OUT to the L level. When this occurs, the transistor $T_{r1}$ of the current limiting circuit 218 is rendered to turn off. In this case, the resistance value of the resistor $R_3$ is preliminarily selected sufficiently large as compared with the resistor $R_1$ so that when the transistor $T_{r1}$ is forced to go off, the current limiting circuit 218 is changed over to a limiting condition where it supplies only a monitor current of a value, e.g., 0.5mA which is lower than the value of the steady-state monitor current such as the previously mentioned 0.7mA.

The operation of the second embodiment will now be described.

Figure 5:
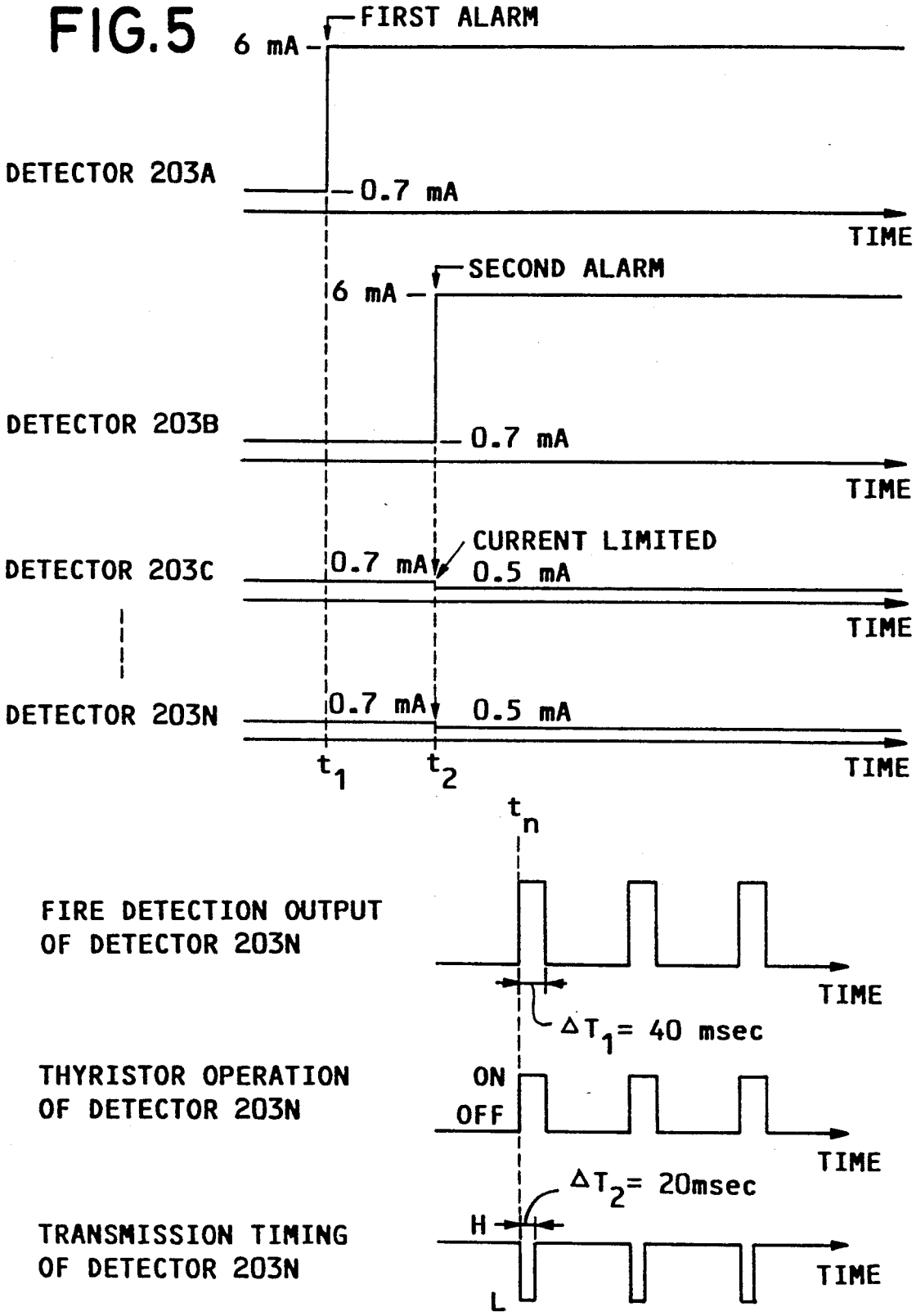
FIG. 5 is a timing chart for explaining the operation of the circuitry in FIG. 3.

Assuming now that of the addressable master detectors 203A to 203N connected to the main circuit **202*a*, 202*b* extended from the receiver 201 shown in FIG. 2, the detection of a fire is made by the addressable master detector 203A at a time $t_1$ as shown in the timing chart of FIG. 5, since the master detector 203A includes the current limiting circuit 218 as shown in FIG. 3, the alarm current from the fire detecting means 204 is limited to 6mA by the current limiting circuit 218 and simultaneously a transmission signal including the fire detection information and the specified address information is transmitted to the receiver 201 from the transmission circuit 206 of the master detector 203. This transmission signal is received by the receiving circuit 209 of the receiver 201 so that the control circuit 210 discriminates the fire detection information and the address information and the alarm indicator 211** indicates the alarm and the alarming detector address.

Then, if another addressable master detector 203B detects the fire at a time $t_2$ in FIG. 5, in the like manner as mentioned previously the alarm current is limited to 6mA by the function of the current limiting circuit of the master detector 203B and the receiver 201 receives the transmission signal from the addressable master detector 203B thus similarly causing the alarm indicator 211 to indicate the detector address.

In this case, if the control circuit 210 of the receiver 201 is preset so that an address-designated current limiting control signal sent to each of the other unalarming master detectors when the number of alarming detector becomes 2, control signals designating the addresses of the other unalarming master detectors 203C to 203N excluding the master detectors 203A and 203B which have already alarmed are sent from the receiver 201.

When each of the unalarming master detectors receives the control signal from the receiver 201, as shown in FIG. 3, the transmission circuit 206 discriminates the current limiting control signal from the receiver 201 so that an L level output is generated at the output terminal of the transmission circuit 206 and the transistor $T_{r1}$ of the current limiting circuit 218 is rendered to turn off. Thus, in the case of the unalarming master detector such as shown as the detector 203N in FIG. 4, then the current steady-state monitor current of 0.7mA is changed over to a lower monitor current of 0.5mA.

In this way, even if any detector alarms are made after the third alarm by the master detector 203N, the line current flowing into the main circuit **202*a*, 202*b* from the receiver 201** is maintained at the alarm current value attained when the number of the alarming detectors reached the preset number of 2 and the line current is no longer increased. Thus, the amount of the voltage drop due to the line resistance is not increased thereby ensuring the subsequent transmission of information between the alarming and unalarming detectors and the receiver.

Where the detection of a fire is made by any of the unalarming master detectors in which the limited current value has been changed over to a lower value by the current limiting control signal from the receiver 201, it operates as follows.

Assume that in the unalarming master detector 203N, for example, the limited current of the current limiting circuit is changed over to the lower value of 0.5mA at the time $t_2$ in FIG. 5 as mentioned previously and then the detection of a fire is made by the detector 203N at the time $t_n$. At this time, in the master detector 203N the fire detecting circuit 221 of the fire detecting means 204 generates an intermittent fire detection output as mentioned in connection with FIG. 4. When the thyristor 222 of the master detector 203N is triggered by the intermittent fire detection output, the thyristor 222 cannot be self-held in the ON state by the previously mentioned limited current value of 0.5mA and it performs the same intermittent on-off operation as the fire detection output. As a result, during the time that the thyristor 222 is turned on, the transistor $T_{r3}$ is turned on and off in the current detecting circuit 205 of the master detector 203N to which the thyristor 222 belongs and the input terminal IN of the transmission circuit 206 is caused to go to the L level intermittently.

If $\Delta T_2$ represents the L-level pulling time of the input terminal IN required for the transmission operation of the transmission circuit 206, generally about 20 sec is required for $\Delta T_2$ at the minimum for the purpose of preventing any noise or the chattering of mechanical contacts. Thus, by selecting the duration time (pulse width) $\Delta T_1$ of the fire detection output to be relatively long, e.g., $\Delta T_1 = 40$ msec as shown in FIG. 5 in relation to the required signal input interval $\Delta T_2 = 20$ msec for the transmission operation of the transmission circuit 206, the transmission of fire detection information and address information for the third alarm on can be effected without any difficulty even if the self-holding of the thyristor 222 in the ON state is not possible due to the current limitation.

It is to be noted that while the alarm indicating light-emitting diode (LED) 208 cannot be turned on due to the current limitation when a fire is detected by any master detector which has been changed over to the current limited condition of the lower current value by the current limiting control signal from the receiver 201, the alarm indicator is primarily utilized for the purpose of confirming the actuated detector by the guard arriving at the alarming area after a fire alarm has been given by the receiver 201 so that while it is necessary to turn on the alarm indicating LEDs for up to about the second alarm, to turn on the alarm indicating LEDs for the third alarm on does not have much significance from the standpoint of confirming the scene of fire and practically no problem is caused in this respect.

Also, while, the receiver 201 detects the alarms from two of the detectors so as to send a current limiting control signal to each of the remaining unalarming detectors, the number of alarming detectors for starting the transmission of current limiting control signals may be suitably determined as occasion demands.

What is claimed is:

1. A fire alarm system comprising:

a central receiving unit;

a pair of power supply and signal main lines connected to said central receiving unit; and a plurality of fire detectors connected to said power supply and signal main lines and forming one or more groups each corresponding to one of the areas under surveillance, said fire detectors including one or more master detectors each thereof being assigned one by one to one of said groups as a group master detector and a plurality of slave detectors one or more thereof being assigned to each of said groups, each of said groups including said one group master detector and said one or more slave detectors connected to said group master detector, each said group master detector including transmission means responsive to the detection of a fire by said group master detector itself or the detection of a fire by each of said one or more slave detectors connected to said group master detector to transmit a fire detection signal and an address signal assigned to each said group to said central receiving unit, said group master detector of each said group is connected with a terminal circuit element for supplying a small steady-state monitor current to a pair of power supply and signal local lines connecting said group master detector and said one or more slave detectors, and disconnection detecting means for generating a disconnection signal when said steady-state monitor current becomes smaller than a predetermined value.

2. A fire alarm system according to claim 1, wherein each said group master detector includes a mounting base, and fire detecting means detachably mounted on said base, and wherein said transmission means is disposed on said mounting base.

3. A fire alarm system comprising;

a central receiving unit;

a pair of power supply and signal main lines connected to said central receiving unit; and a plurality of fire detectors connected to said power supply and signal main lines and forming one or more groups each corresponding to one of the areas under surveillance, said fire detectors including one or more master detectors each thereof being assigned one by one to one of said groups as a group master detector and a plurality of slave detectors one or more thereof being assigned to each of said groups, each of said groups including said one group master detector and said one or more slave detectors connected to said group master detector, each said group master detector including transmission means responsive to the detection of a fire by said group master detector itself or the detection of a fire by each of said one or more slave detectors connected to said group master detector to transmit a fire detection signal and an address signal assigned to each said group to said central receiving unit each of said fire detectors includes switching means responsive to the detection of a fire so as to be turned on to supply an alarm current, and wherein each said group master detector includes current limiting means for limiting said alarm current to a constant current value large enough for the maintenance of said ON state of said switching means.

4. A fire alarm system according to claim 3, wherein each of said fire detectors includes pulse driving means for periodically turning said switching means on upon the detection of a fire.

5. Fire alarm system according to claim 3, wherein said central receiving unit includes control means for determining the number of said group master detectors which have been alarming to deliver to said power supply and signal main lines control signals each designating a specified address of one of said group master detectors which have not been alarming when the number of said alarming group master detectors exceeds a predetermined number, and wherein each said group master detector includes current limit changeover means for changing over the limited current value of said current limiting means thereof to a value lower than said constant current value when one of said control signals from said central receiving unit is discriminated in accordance with the specified address thereof by said transmission means.

6. In a fire alarm system wherein a plurality of addressable detectors having respective specified addresses and connected to a pair of power supply and signal main lines connected to a central receiving unit, each of said addressable detectors including fire detecting means having switching means responsive to the detection of a fire so as to be turned on and held in said ON state to supply an alarm current, current detecting means for detecting said alarm current and transmission means for transmitting a signal of said specified address to said power supply and signal main lines when said current detecting means detects said alarm signal and for selectively receiving said control signals delivered onto said power supply and signal main lines from said central receiving unit in accordance with the address information of each of said addressable detectors, said central receiving unit including indicating means for receiving said specified address signals transmitted to said central receiving unit from said power supply and signal main lines to discriminate and indicate said alarming detectors, the improvement wherein said central receiving unit includes control means responsive to said received specified address signals whereby when the number of said alarming detectors is greater than a predetermined number control signals each designating the specified address of one of the other of said detectors which have not been alarming are delivered onto said power supply and signal main lines, and wherein each of said addressable detectors includes current limiting means for limiting said alarm current generated upon the detection of a fire to a constant current value just required for turning on and maintaining said switching means in said ON state, and current limit changeover means whereby when said transmission means receives said control signal of the address corresponding to each said addressable detector from said power supply and signal main lines, the limited current value of said current limiting means of each said addressable detector is decreased to a value smaller than said constant current value.

* * * * *